United States Patent [19]

Burnett et al.

[11] 3,961,580

[45] June 8, 1976

[54] ENERGY-ABSORBING SABOT

[75] Inventors: William M. Burnett, Oxon Hill; Albert W. Horst, Jr., Accokeek, both of Md.

[73] Assignee: The United States of America as represented by the Secretary of the Navy, Washington, D.C.

[22] Filed: Feb. 27, 1975

[21] Appl. No.: 553,848

[52] U.S. Cl. ..... 102/93
[51] Int. Cl.[2] ..... F42B 13/16
[58] Field of Search ..... 102/93

[56] References Cited

UNITED STATES PATENTS

| | | | |
|---|---|---|---|
| 2,715,874 | 8/1955 | Hablutzel et al. | 102/93 |
| 3,359,905 | 12/1967 | Engel | 102/93 |
| 3,695,181 | 10/1972 | Bull et al. | 102/93 |
| 3,862,603 | 1/1975 | Kornblith et al. | 102/93 |

*Primary Examiner*—Verlin R. Pendegrass
*Attorney, Agent, or Firm*—R. S. Sciascia; J. A. Cooke; F. K. Yee

[57] ABSTRACT

A one-piece sabot of the can type comprises an energy storage means positioned between the obturator and the aft end of the subcaliber projectile and means for mounting the sabot on the projectile in one of a plurality of axial positions. Energy stored in the storage means during the initial phase of launch is released after launch to effect projectile-sabot separation.

4 Claims, 2 Drawing Figures

ENERGY-ABSORBING SABOT

BACKGROUND OF THE INVENTION

The present invention relates to sabots and more particularly to a one-piece sabot having an energy storage means to effect separation after launch.

The use of sabots to launch subcaliber projectiles from large-bore launchers results in many advantages, such as increased range, accuracy and penetrating force. Accordingly, considerable effort has been devoted to improving and refining sabot design.

In general the sabot must protect the projectile from shock during firing; it must form a tight gas seal to insure transmission of maximum driving force to the projectile; and it must not adversely affect the projectile flight. This last requirement means that, among other things, the sabot must separate cleanly and efficiently from the projectile at the proper time so as not to produce range-decreasing drag or other accuracy-decreasing forces. Furthermore, the sabot must not present undue debris hazards to the ground personnel after separation.

In addition to the above general requirements, it is highly desirable that the sabot be of simple construction, with a minimum of parts and be of wide adaptability. These features permit the sabot to be mass produced economically and be easily adapted for use with a large variety of projectiles and launchers.

Present sabot designs may be of one-piece design or be an assembly of numerous elements. The multiple-element designs are complex, more time-consuming to assemble, are more prone to failure, and cannot be readily adapted to different launcher requirements. The sabot disclosed in Engel, U.S. Pat. No. 3,359,905, is an example of the complex, multiple-element design.

During projectile launch a large quantity of energy is developed by the expanding gases acting upon the sabot and the projectile. Presently known sabots do not effectively utilize this energy to effect sabot separation, depending primarily upon drag, centrifugal force or some other means to separate the sabot from the projectile. Such separation methods adversely affect the projectile's range, accuracy and penetrating force. Nee, in U.S. Pat. 3,677,131, compresses a spring which is released after launch to separate the projectile from a launcher bulkhead. No energy of launch, however, is used in compressing the spring. In the aforesaid patent to Engel, a complex mechanism involves the use of a disk spring compressed during acceleration to unlock a projectile retaining ring, after which the spring helps the separation of the projectile from the sabot. But as already mentioned supra, the Engel sabot is complex and is of fixed design which renders wide adaptability to different launchers difficult.

SUMMARY OF THE INVENTION

Accordingly an object of the present invention is to provide an improved sabot having a simple and efficient design.

Another object of the invention is to provide an improved sabot having few parts.

Yet another object of the invention is to provide an improved sabot of simple design which can be easily adapted to fit a variety of projectiles.

Still a further object of the invention is to provide an improved sabot which effectively utilizes energy produced during launch to effect sabot separation.

These and other objects of the present invention are attained in a sabot of the one-piece, can type having an energy storage means, such as a spring or the like, positioned between the aft surface of the projectile and the obturator. The sabot is attached to the projectile by shear pins mounted between pin seats in the sabot walls and one of a plurality of sets of pin-receiving holes on the projectile. By selecting a particular set of holes, the overall length of the sabot-projectile combination may be adjusted to launcher requirements. The energy storage means or spring can be pre-compressed when the spring is mounted onto the projectile. Upon firing, projectile inertia severs the shear pins and further compresses the spring. After launch, decrease of A more complete understanding of the invention and a fuller appreciation of the many attendant advantages thereof will be derived by reference to the following.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DESCRIPTION OF THE PREFERRED EMBODIMENTS

Figure 1:
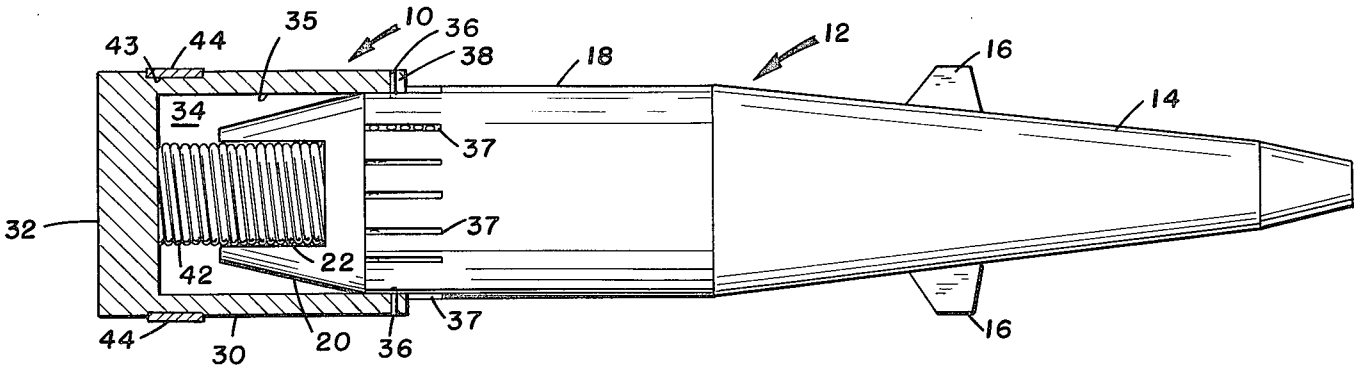
FIG. 1 shows a projectile in combination with a sabot of the present invention.

Referring now to the drawings wherein like reference numerals designate corresponding parts in the several views, there is shown in FIG. 1 a sabot 10 positioned on a projectile 12 which is adapted to be fired from a suitable launcher (not shown).

Projectile 12 has a tapered, forward or nose section 14 and a substantially cylindrical mid section 18 terminating in a tapered, after boattail section 20 having a central recess 22 therein. A plurality of front bore riders 16 are attached to the nose section 14 to support the forward portion of the projectile during launch. The projectile may be any type of subcaliber round which is to be fired from a large bore launcher.

Attached to the projectile 12 approximate the rear portion of mid section 18 and encompassing the boattail section 20 is a sabot 10 having a cylindrical wall 30 extending aft and terminating in an obturator 32 to form a void space 34 between the boattail section and the obturator. The inner surface of wall 30 is provided with a plurality of longitudinal grooves alternating with longitudinal ridges 35, both circumferentially spaced along the circumference of wall 30 and extending substantially the length thereof. In the assembled position of FIGS. 1 and 2, the ridges 35 mesh with similarly shaped longitudinal grooves 37, provided around the outer surface of mid section 18 and extending approximately half the length thereof to insure positive transmission of spin forces from the sabot 10 to the projectile 12. The longitudinal shape of the ridges and grooves prevents relative rotation, but permits longitudinal displacement.

Figure 2:
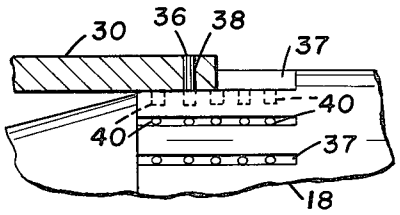
FIG. 2 is an enlarged, partial showing of the shear pin attachment and supporting means.

As shown more clearly in FIG. 2, each longitudinal groove 37 is provided with a series of spaced holes 40, spaced longitudinally and extending radially inward. Shear pins 36 are passed through a plurality of holes 38 provided in wall 30 near the front, open end of sabot 10 and engage a set of the holes 40 to position and attach the sabot to the projectile 12.

Located within the space 34 is an energy absorbing means, such as a spring 42 positioned within the recess 22. Circumscribing the outer surface of wall 30 is an annular recess 43 to receive a driving band 44. As is known in the art, the driving band is of reasonably soft material, such as copper, which is forced against the rifling of the launcher barrel under impact of the firing to impart a rotation to the sabot.

The plurality of pin-receiving holes 40 in each of the longitudinal grooves 37 provide several advantages to the sabot 10. For example, the overall length of the projectile-sabot combination can be easily and quickly adjusted by selecting a particular set of holes 40. Thus, the combination can be adjusted in the field just prior to firing to fit a variety of launchers. There are no complex parts to be adjusted, and therefore the combination can be quickly changed to fit a variety of requirements. By positioning shear pins 36 in a particular set of holes, a predetermined amount of compression can be applied to spring 42. Thus, a variety of powder charges and/or launcher dimensions and firing requirements can be accommodated to ensure safe and reliable separation between the sabot and the projectile after launch.

While a mechanical spring 42 has been illustrated as the energy storage means, other means are contemplated which are equally suitable, such as high-density elastomeric material or liquid recoil spring. Of course, springs having different spring constants can readily be interchanged to alter the sabot separation force. Similarly, while shear pins 38 have been shown as the sabot attaching means, any other means of attachment which would provide a predeterminable separating force are acceptable, such as adhesives or shear rings.

A method of loading and firing projectile 12 from a large bore launcher includes the steps of: encasing sabot 10 about projectile 12 at a preselected position on said projectile; compressing spring 42 between the projectile boattail and obturator 32; securing the sabot to the projectile by means of shear pins 36 seated in pin seats 38 and holes 40; and loading the sabot-projectile combination into a launcher. The energy stored in spring 42 by the initial compression may, or may not, be sufficient to separate the sabot from the projectile. In either case, the compression of the spring is effected by the shear pins 36, and thus the initial compression force should be less than the force required to shear pins 36.

Upon firing, the sabot-projectile combination accelerates rapidly. Spring 42 in the sabot will absorb the energy of a cartridge impact to reduce the possibility of an accidental projectile explosion while the projectile is still in the launcher. During the acceleration phase of launch, the inertia of the projectile will shear the pins 36 and further compress spring 42 to increase the energy stored therein. Upon exiting the launcher, the combination begins to decelerate, and with the inertia of projectile 12 directed in the opposite direction the compressing force is released from spring 42. Upon reaching a preselected level of acceleration or deceleration, the compression of spring 42 relaxes sufficiently to allow the spring to extend and separate sabot 10 from projectile 12. The sabot thus separated remains in one piece, thus reducing the hazard of flying fragments injuring ground personnel. The total spring compression can be selected to minimize the range of the ejected sabot and thus further increase the safety features of this combination. Firing energy developed by the gases expanding behind the projectile-sabot combination is thus efficiently utilized to effect safe, effective sabot separation. The spring constant and/or precompression can be adjusted to most effectively utilize the firing energy generated by a variety of different launchers. Adjustment of the sabot is thus quick and easy and does not require changes in the manufacture thereof. This feature provides significant advantages over presently known sabots which must be redesigned to accommodate launcher design changes.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. In combination, a subcaliber projectile and a sabot for launching the projectile comprising:

a sabot positionable adjacent the aft portion of the projectile, said sabot having an obturating surface;

a plurality of longitudinal ridges on the inner surface of said sabot;

a plurality of longitudinal grooves on the projectile which slidably receives said longitudinal ridges;

a plurality of positioning recesses longitudinally spaced along said longitudinal grooves;

a plurality of shear elements on said sabot receivable in said recesses for attaching the sabot to the projectile in one of a plurality of longitudinal positions; and an energy storage means positioned between the sabot obturating surface and the aft end of the projectile for effectuating sabot separation from the projectile subsequent to projectile launch, whereby the relative positioning of said sabot on the projectile establishes the overall length of the projectile and establishes an initial energy level in said energy storage means.

2. The combination of claim 1 wherein said potential energy storage means comprises a spring, one portion of said spring being received in a recess on the aft end of the projectile, said spring being compressed during projectile launch.

3. The combination of claim 2 further comprising torque-transmission means on said sabot to impart rotation to the projectile.

4. A method of firing a subcaliber projectile comprising the steps of:

encasing the projectile aft end in a sabot;

positioning a spring between the aft end of said projectile and said sabot;

selecting the overall length of the projectile-sabot combination and establishing an initial compression of said spring by positioning said sabot in one of a plurality of longitudinal locations on said projectile;

securing said sabot to said projectile by engaging a plurality of shear elements on said sabot with a set of recesses selected from a plurality of longitudinally-spaced recesses on said project;

loading said projectile into a launcher;

forcibly ejecting said projectile from the launcher;

severing said shear elements and further compressing said spring to increase the potential energy of said spring; and releasing the energy stored in said spring to separate said sabot from said projectile.

* * * * *